United States Patent [19]

Vanags

[11] 4,340,981

[45] Jul. 27, 1982

[54] BATHING DEVICE

[75] Inventor: Paul Vanags, Swansea, Wales

[73] Assignee: Portasauna Limited, Merthyr Tydfil, Wales

[21] Appl. No.: 181,837

[22] Filed: Aug. 27, 1980

[30] Foreign Application Priority Data

Aug. 30, 1979 [GB] United Kingdom ..... 7930108

[51] Int. Cl.[3] ..... A61H 33/06

[52] U.S. Cl. ..... 4/536; 4/524; 4/525; 4/535; 4/616; 4/625

[58] Field of Search ..... 4/536, 524, 525, 526, 4/518, 527, 602, 603, 534, 535, 545, 546, 552, 567, 596, 598, 599, 615, 616, 625

[56] References Cited

U.S. PATENT DOCUMENTS

| | | | |
|---|---|---|---|
| 2,454,518 | 11/1948 | McCann | 4/598 |
| 2,567,614 | 9/1951 | Merriam | 4/598 |
| 3,007,178 | 11/1961 | Altman et al. | 4/525 |
| 3,351,956 | 11/1967 | Thöner | 4/527 |
| 3,396,411 | 8/1968 | Vieceli | 4/525 |
| 3,587,118 | 6/1971 | Compton | 4/598 |
| 3,606,618 | 9/1971 | Veech | 4/603 |

*Primary Examiner*—Henry K. Artis

*Attorney, Agent, or Firm*—Parmelee, Miller, Welsh & Kratz

[57] ABSTRACT

A bathing device (10) comprises a cabinet having an upper part (11) with an access opening (56) and a seat within the cabinet on which a person can sit, means (59) at least substantially to close the opening (56), means providing an aperture through which the head of the person can project, and a lower casing part (12) containing a reservoir (17) for water, a heating element (30), means (34) to supply water from the reservoir to the heating element (30) to generate steam, means to supply water from the reservoir (17) to the interior of the cabinet to wash a person, a holding tank (18) for used water, and means to collect the used water and deliver it to the holding tank (18).

10 Claims, 2 Drawing Figures

BATHING DEVICE

BACKGROUND OF THE INVENTION

This invention relates to a bathing device.

Conveniently, a bath or shower to wash is taken in a bath or shower which is a fixture. Persons also take Turkish baths, where the person is enveloped in hot moist steam, or a sauna bath, where a person is immersed in hot air and intermittently subjected to hot dry steam. Again such baths are taken in a fixture.

SUMMARY OF THE INVENTION

The object of the invention is to provide a bathing device which renders more convenient the taking of all the above mentioned types of baths, particularly, but not exclusively, in a domestic environment.

According to the invention we provide a bathing device comprising a cabinet having an upper casing part with an access opening, means at least substantially to close the opening, a seat within the upper part on which a person can sit, and means providing an aperture through which the head of the person can project, and a lower casing part containing a reservoir for water, a heating element, means to supply water from the reservoir to the heating element to generate steam, means to supply water from the reservoir to the interior of the cabinet to wash a person, a holding tank for used water, and means to collect the used water and deliver it to the holding tank.

A heating means may be provided to heat the water in the reservoir or the water delivered from the reservoir for washing.

Control means may be provided to permit of heating air within the cabinet, for feeding water intermittently to a heating element to provide a sauna bath, for feeding water continuously to the heating element to provide a Turkish bath and for feeding water for washing.

Preferably, said control means and/or heating means are provided in said lower casing part.

The lower casing part may comprise a top wall surrounded by a downwardly depending side wall, the top wall having two recesses formed therein one of which provides said water reservoir and the other of which provides said holding tank.

The top wall may have an upwardly projecting part which extends into the interior of the upper casing part and is adapted to provide an electrical supply means to the heating element.

Preferably, the upper and lower casing parts are made as mouldings in suitable synthetic plastics material such as grp.

Preferably, the closure means for the access opening comprises a flexible sheet which substantially closes the opening except for a region which provides the said aperture through which the person's head may project.

Preferably the flexible sheet comprises two portions with a fastening means such as a zip fastening therebetween; the parts of the sheet being fixed to the upper casing part adjacent the edge of the access opening.

Preferably, the upper and lower casing parts comprise one-piece mouldings in said plastics material and said reservoir and holding tank are formed integrally with the remainder of the lower casing part.

BRIEF DESCRIPTION OF THE DRAWINGS

One embodiment of the invention will now be described in detail by way of example only with reference to the accompanying drawings wherein.

DESCRIPTION OF PREFERRED EMBODIMENT

Figure 1:
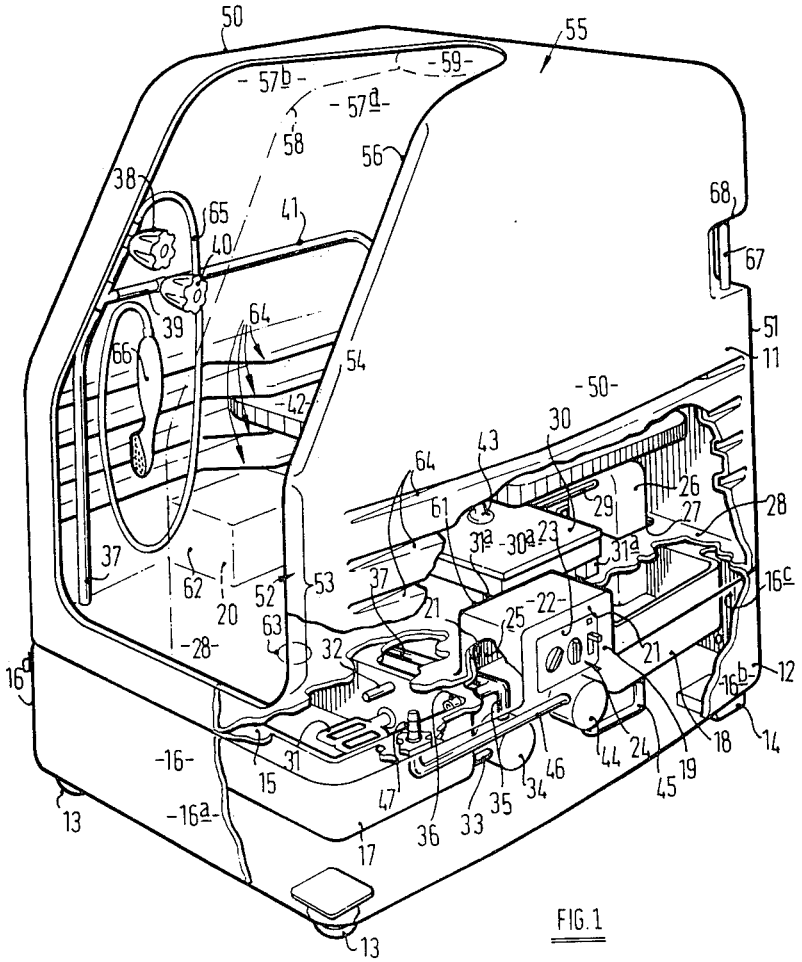
FIG. 1 is a broken away perspective view of a bathing device embodying the invention.
Figure 2:
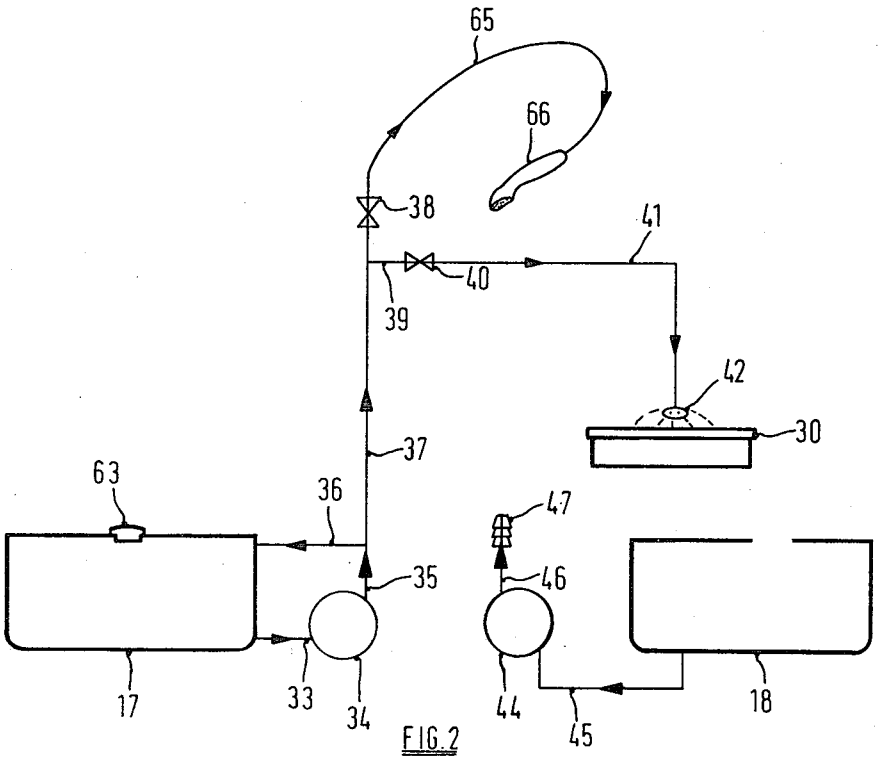
FIG. 2 is a diagrammatic representation illustrating the water flow bath for the device of FIG. 1.

Referring to FIG. 1, the bathing device is generally indicated at 10 and comprises an upper casing part 11 and a lower casing part 12 each made as one-piece mouldings in a suitable synthetic plastics material such as grp.

The lower casing part 12 provides the base of the unit and has projecting from its under surface a pair of castors 13 at its forward end and a pair of feet 14 at its rearward end. The lower casing part 12 has a generally horizontal top wall 15 from which a downwardly depending side wall 16 depends. The lower casing part 12 is of generally rectangular configuration in plan view and hence the side wall 16 has four orthogonally arranged portions 16*a*, 16*b*, 16*c* and 16*d*.

The top wall 15 has formed integrally therewith two recesses 17, 18. The recess 17 provides a generally rectangular open-topped reservoir for fresh water and the recess 18 provides a similar rectangular in plan view open-topped holding tank for used water.

At each side of the lower casing part, the top wall 15 is formed with an upwardly projecting portion 19, 20 which has generally vertically upstanding side walls 21 and a generally horizontal top wall 22. One of the side walls 21 provides a continuation of the side wall 16*b* of the casing part 12 and has an aperture 23 therein in which is received a control panel 24 whilst the space 25 within the projecting part 19 accommodates the control elements behind the panel 23 as hereinafter to be described.

Also projecting upwardly from the upper wall 15 is a plinth 26 at a location adjacent the mid-point of the rear side wall 16*c* of the base but spaced inwardly from the side wall 16*c* so that it can project through an aperture 27 formed in a generally horizontal base wall 28 of the upper casing part 11.

The plinth 26 has a sheathed electrical connection 29 extending forwardly therefrom to provide electrical power supply to a heating plate 30 as hereinafter to be described.

Mounted within the reservoir 17 is a conventional electrical immersion heating element 31 and a thermostat 32. A pipe 33 extends from the lower end of the reservoir 17 to an electrically operated pump 34 from which a delivery pipe 35 extends which branches into a return pipe 36 to the reservoir 17 and a fresh water delivery pipe 37 which extends beneath the top wall 15 and then upwardly within the upper casing part 11 to a shower control valve 38 and is branched, as shown at 39 to a steam control valve 40. Downstream of the valve 40, a water delivery pipe 41 extends within the upper casing part 11 to a position below a seat 42 provided therein and terminates in a spray head 43 to deliver water to the upper surface of the heating plate 30.

Also mounted below the upper wall 15 within the lower casing part 12 is a further pump 44 to which used water is fed from the holding tank 18 by a pipe 45 and which is arranged to deliver the used water via a pipe 46 to a connector 47 to which a flexible hose may be connected to permit the waste water to be pumped from the holding tank 18 either directly into a drain or into a portable container or otherwise as desired.

The upper casing part 11 comprises generally planar lateral side walls 50 and a back wall 51, together with a front wall 52 the lower part of which extends vertically upwardly as indicated at 53 and the upper part of which is inclined upwardly and rearwardly as indicated at 54 and merges with a generally horizontal top wall 55. An access opening 56 is formed in the front wall 52 and is arranged to be closed by flexible sheets 57*a*, 57*b* connected to the upper casing part 11 around the periphery of the opening 56 and arranged to be connected together by a sliding clasp fastening 58. The sheets 57*a*, 57*b* do not completely close the opening 56 but provide an aperture 59 through which the head of a person sitting on the seat 42 can project with the sheets 57*a*, 57*b* engaged closely around the neck of the person to provide a seal for the environment within the casing parts.

As mentioned previously, the upper casing part 11 has a generally horizontal lower wall 28 provided with the aperture 27 and also having box-like projections 61, 62 to accommodate the upstanding parts 19 and 20 respectively of the lower casing part. The wall 28 is also provided with a filler aperture closed by a cap 63 to permit access to be gained to the lower casing part whereby the reservoir 17 can be filled.

Supported on the wall 28 is the heating plate 30 which comprises a metal, generally rectangular, plate 30*a* heated by an electrical heating element therebeneath (not shown); the plate 30 is supported on legs 31*a* of heat insulating material from the wall 28 and is located beneath the seat 42 which comprises a suitable piece of wood or if desired moulding of synthetic plastics material, at a desired height by being slid between desired ribs 64 formed integrally in the side walls 50 of the upper casing part 11.

As mentioned previously, mounted within the upper casing part 11 are spray and steam control valves 38, 40. Connected to the spray valve 38 is a conventional flexible hose 65 having at its end a conventional hand-held shower head 66. A handle 67 is provided in a recess 68 on each side of the upper casing part 11 adjacent the rear thereof to permit the bathing device to be moved by lifting the rear feet 14 from the ground and rolling the device on the castors 13. The overall dimensions are such that the device can be passed through standard doorways of a house.

The edge of the access opening 56 is preferably provided with a foamed plastics material moulding to provide a smooth and soft edge to avoid any possibility of discomfort to a user on entry into the device.

The lower wall 28 provides, of course, a lid for the reservoir 17 and holding tank 18.

The underside of the lower casing part 12 is closed by a removable plate (not shown) to prevent inadvertent access to the controls, pumps and electric wiring etc. The upper and lower casing parts are bonded together using a suitable bonding agent. If desired, a timing device may be provided in the main electric supply to the device so that it is switched off after a predetermined period of time, for example half an hour, in case a user of the device forgets to switch it off and to avoid thereby any risk of damage due to overheating. Furthermore, if desired, thermostats may be provided within the device at appropriate positions to avoid overheating.

The control panel may be provided with a warning light to indicate the device is connected to a supply of electric power and a switch provided for the fresh water pump 34 and for the used water pump 44 as well as for the immersion heater element 31 and the heating plate 30. If desired, all these switches may be arranged to illuminate an indicator light when their function is operative. If desired, a switch may be provided with an interlock so that only one source of power is operated at a time to avoid overloading of the power supply. For example, if the heating plate 30 is switched on energisation of the immersion heater element is prevented. Of course, if a higher current supply than the normal 13 amp domestic supply is available, for example a 30 amp supply, such an interlocking arrangement need not be provided.

The heating plate 30 in the present example is not thermostatically controlled, the temperature of the heating plate being limited by the loss of heat due to radiation, conduction and convection. On the other hand the immersion heater element 31 is thermostatically controlled to ensure that the water in the tank 17 is not raised above a predetermined temperature.

If desired, portable containers may be provided with the bathing device so that the correct amount of water can be conveniently carried to and fed into the reservoir 17 to permit the holding tank 18 to be conveniently emptied of the water therefrom into one of the containers using the pump 44 and a flexible hose connected to the connector 47.

If desired, a pressure release valve may be provided in the pipe 38 so that water is recirculated through the reservoir 17 to ensure mixing and hence uniform temperature of the water. If however the tap 38 or the tap 40 is opened, the pressure release valve will close and water will preferentially be fed through which ever of the taps is open.

If desired, the valve 40 may be spring loaded so that it automatically returns to a closed position when not maintained open by the user whilst the tap 38 is preferably of the conventional type which will remain in any position to which it is set by the user.

The heating plate 30 may be provided with a raised rim to retain water spread thereon.

Suitable protective bars or grills are provided beneath the seat 42 to prevent inadvertent access to the heating plate 30.

To provide a good seal for the flexible covers 57*a* and 57*b* on the neck of a user, preferably two relatively rigid semi-circular members are secured to the cover parts 57*a*, 57*b* and are pivoted together at the end thereof distant from the sliding clasp fastener 58. Within the semi-circular parts are provided two semi-circular rubber diaphragm members so that when a user of the apparatus closes the semi-circular units around his neck, the rubber diaphragm members deform to permit the closure to take place and to provide a sealing engagement with the user's neck.

The bottom wall 28 of the upper body part 11 is preferably provided with a plurality of downwardly projecting ribs which form depressions on the upper surface which act both to strengthen the floor and give it rigidity and also as drainage channels for the used water and an opening is provided in the floor 28 above the holding tank 18 which is closed by a grid to permit used water to drain into the holding tank 18.

I claim:

1. A portable bathing device comprising a cabinet having an upper casing part with an access opening, means at least substantially to close the opening, a seat within the upper part on which a person can sit, and means providing an aperture through which the head of the person can project, and a lower casing part having a substantially horizontal top wall substantially separating said lower casing from said upper casing, said lower casing containing a reservoir for water, a heating element, means to supply water from the reservoir to the heating element to generate steam, means to supply water from the reservoir to the interior of said upper casing part to wash a person, a holding tank in said lower casing for used water, and means to collect the used water from said upper casing and deliver it to the holding tank.

2. A bathing device according to claim 1 wherein a heating means is provided to heat the water in the reservoir or the water delivered from the reservoir, for washing.

3. A bathing device according to claim 1 or claim 2 wherein control means are provided to permit of heating air within the cabinet, for feeding water intermittently to a heating element to provide a sauna bath, for feeding water continuously to the heating element to provide a Turkish bath and for feeding water for washing.

4. A bathing device according to claim 3 wherein said control means and/or heating means are provided in said lower casing part.

5. A bathing device according to claim 1 wherein the lower casing part comprises a top wall surrounded by a downwardly depending side wall, the top wall having two recesses formed therein one of which provides said water reservoir and the other of which provides said holding tank.

6. A bathing device according to claim 5 wherein the top wall has an upwardly projecting part which extends into the interior of the upper casing part and is adapted to provide an electrical supply means to the heating element.

7. A bathing device according to claim 1, wherein the upper and lower casing parts are made as mouldings in suitable synthetic plastics material such as grp.

8. A bathing device according to claim 1, wherein the closure means for the access opening comprises a flexible sheet which substantially closes the opening except for a region which provides the said aperture through which the person's head may project.

9. A bathing device according to claim 8 wherein the flexible sheet comprises two portions with a fastening means such as a zip fastening therebetween, the parts of the sheet being fixed to the upper casing part adjacent the edge of the access opening.

10. A bathing device according to claim 7 wherein the upper and lower casing parts comprise one-piece mouldings in said plastics material and said reservoir and holding tank are formed integrally with the remainder of the lower casing part.

* * * * *